United States Patent [19]

Gibson et al.

[11] 4,078,931

[45] Mar. 14, 1978

[54] AMINOLYZED TONER COMPOSITIONS AND IMAGING PROCESS USING SAME

[75] Inventors: Harry W. Gibson, Penfield; Wolfgang H. H. Gunther, Webster, both of N.Y.

[73] Assignee: Xerox Corporation, Stamford, Conn.

[21] Appl. No.: 500,769

[22] Filed: Aug. 26, 1974

[51] Int. Cl.[2] ..... G03G 13/08; G03G 9/10

[52] U.S. Cl. ..... 96/1 SD; 252/62.1 P; 260/37 P; 427/19; 526/49

[58] Field of Search ..... 117/17.5; 252/62.1; 96/1 SD; 260/37 P, 37 NP, 42.16; 526/49; 427/14, 20, 19

[56] References Cited

U.S. PATENT DOCUMENTS

| | | | |
|---|---|---|---|
| B 422,399 | 1/1975 | Strella et al. | 117/17.5 |
| 3,203,935 | 8/1965 | Miranda et al. | 526/49 X |
| 3,553,133 | 1/1971 | Olson | 252/62.1 P |
| 3,554,946 | 1/1971 | Okuno et al. | 252/62.1 |
| 3,579,451 | 5/1971 | Sciambi | 117/17.5 |
| 3,585,172 | 6/1971 | Nishiyama et al. | 526/49 X |
| 3,623,986 | 11/1971 | Machida et al. | 252/62.1 |
| 3,634,251 | 1/1972 | Maeda et al. | 252/62.1 |
| 3,681,106 | 8/1972 | Burns et al. | 252/62.1 P |
| 3,681,107 | 8/1972 | Moriconi et al. | 117/17.5 |
| 3,779,926 | 12/1973 | Merck et al. | 252/62.1 |
| 3,793,048 | 2/1974 | Nagashima et al. | 117/17.5 |
| 3,798,167 | 3/1974 | Kukla et al. | 96/1 SD |
| 3,809,554 | 5/1974 | Merrill et al. | 117/17.5 |

FOREIGN PATENT DOCUMENTS

| | | | |
|---|---|---|---|
| 2,103,045 | 8/1971 | Germany | 252/621 |
| 44-17074 | 1969 | Japan | 252/62.1 |
| 47-41931 | 10/1972 | Japan | 252/62.1 P |

*Primary Examiner*—Ronald H. Smith
*Assistant Examiner*—Stuart D. Frenkel

[57] ABSTRACT

Electrostatographic developer compositions for use in developing electrostatic latent images wherein the triboelectric charging potential of functional polymers employed in the toner materials are controlled through chemical alteration by aminolysis of ester functions. The controlled variation of the triboelectric behavior of functional polymers by aminolysis provides a means of attaining optimum triboelectric responses in development systems.

11 Claims, 3 Drawing Figures

AMINOLYZED TONER COMPOSITIONS AND IMAGING PROCESS USING SAME

This invention relates in general to imaging systems and more particularly to improved electrostatographic developer mixtures for use in such systems.

The formation and development of images on the surface of photoconductive materials by electrostatographic means is known. The basic electrostatographic process as taught by C. F. Carlson in U.S. Pat. No. 2,297,691 involves placing a uniform electrostatic charge on a photoconductive insulating layer, exposing the layer to a light and shadow image to dissipate the charge on the areas of the layer exposed to the light, and developing the resultant electrostatic latent image by depositing on the image, a finely-divided electroscopic material referred to in the art as "toner." The toner is attracted to those areas of the layer which retain a charge, thereby forming a toner image corresponding to the electrostatic latent image. This "powder" image may then be transferred, usually electrostatically, to a support surface such as paper. The transferred image may subsequently be permanently affixed to the support surface by heat or other suitable affixing means such as solvent or overcoating treatment may be used instead.

Many methods are known for applying the electroscopic particles to the latent image to be developed. One development method as disclosed by E. N. Wise in U. S. Pat. No. 2,618,582 is known as "cascade" development. In this method, developer material, comprising relatively large carrier particles, having finely-divided toner particles electrostatically clinging to the surface of the carrier particles, is conveyed to, and rolled or cascaded across the surface bearing the electrostatic latent image. The charged portions of the surface have a charge of the same polarity as, but stronger than, the carrier particles. Toner and carrier particles having opposite polarities are selected so that the toner particles cling to the carrier particles. In order to develop a negatively charged electrostatic latent image, a toner and carrier combination are selected in which the toner is triboelectrically positive in relation to the carrier. Conversely, to develop a positively charged electrostatic latent image, a toner and carrier combination wherein the toner is triboelectrically negative in relation to the carrier is used. The triboelectric relationship between the toner and carrier depends on the relative positions of the materials in the "triboelectric series." In this series, materials are arranged in ascending order of their ability to take on a positive charge. Each material is positive with respect to any material classified above it in the series; and, negative with respect to any material above it in the series. As the developer mixture cascades or rolls across the image-bearing surface, the toner particles are electrostatically attracted from the carrier to the charged portions of the image-bearing surface, whereas they are not electrostatically attracted to the uncharged or background portions of the image which they contact. The carrier particles and unused toner particles are then recycled. The cascade development process is extremely good for the development of line copy images, and is the most widely used commercial electrostatographic development technique. A general purpose office copying machine incorporating this technique is described in U. S. Pat. No. 3,099,943.

Another technique for developing electrostatic latent images is the "magnetic brush" process as disclosed, for example, in U.S. Pat. No. 2,874,063. In this process, a developer material containing toner and magnetic carrier particles is attracted to and is carried by a magnet. The magnetic field causes alignment of the magnetic particles in a brush-like configuration. When this magnetic brush is brought into contact with an electrostatic latent image-bearing surface, the toner particles are attracted from the carrier particles of the brush to the charged areas of the image-bearing surface but not to the uncharged areas. Since the charged areas have an imagewise configuration, the toner material clings to the surface in imagewise configuration, thus developing the latent image.

Another method for developing electrostatic latent images is disclosed in U.S. Pat. No. 3,503,776 issued to R. W. Gundlach. In this method, images are formed by transporting an electrostatic latent image-bearing surface in a generally ascending arcuate path, and contacting only the image in a contact zone with a bath of developer material transported in a concave chamber adjacent to the lower path of the imaging surface. The contact zone extends from about the lower-most point of the arcuate path to the uppermost point of the arcuate path. As the imaging surface is transported along its arcuate path, frictional contact between the developer and the imaging surface in the contact zone circulates the developer in the bath and brings developer material into developing configuration with the imaged surface.

Many other methods, such as the "touchdown" development method disclosed by C. R. Mayo in U.S. Pat. No. 2,895,847 are known for applying electroscopic particles to the electrostatic latent image to be developed. The development process, as described above, together with numerous modifications, are well-known to the art through various patents and publications and through the widespread availability and utilization of electrostatographic imaging equipment.

In automatic reproduction equipment, it is conventional to employ as the imaging plate, a photoconductor on a conductive substrate in the form of a cylindircal drum or a flexible belt which is continuously rotated through a cycle of sequential operations including charging, exposing developing, transferring, and cleaning. The developer chamber is charged with a developer mixture comprising carrier particles and enough toner particles for hundreds of reproduction cycles. Generally, the freshly charged developer mixtures contain between about 1.5 and about 5% toner particles based upon the weight of the developer. This initial concentration provides sufficient toner for many reproduction cycles without causing undesirably high background toner deposition.

While ordinarily capable of producing good quality images, conventional developing systems suffer serious deficiencies in certain areas. In the reproduction of high contrast copies such as letters, tracings, and the like, it is desirable to select the electroscopic powder and carrier materials so that their mutual electrification is relatively large; the degree of such electrification being governed in most cases by the distance between their relative positions in the triboelectric series. However, when otherwise compatible electroscopic powder and carrier materials are removed from each other in the triboelectric series by too great a distance, the resulting images are very faint because the attractive forces between the carrier and toner particles compete with the attractive forces between the electrostatic latent image and the carrier particles. Although the image density described in the immediately preceding sentence may be improved by increasing the toner concentration in the developer mixture, undesirably high background toner deposition as well as increased toner impaction and agglomeration is encountered when the developer mixture is overtoned. The initial electrostatographic plate charge may be increased to improve the density of the deposited powder image, but the plate charge would ordinarily have to be excessively high in order to attract the electroscopic powder away from the carrier particle. Excessively high electrostatographic plate charges are not only undesirable because of the high power consumption necessary to maintain the electrostatographic plate at high potentials, but also because the high potential causes the carrier particles to adhere to the electrostatographic plate surfaces rather than merely roll across and off the electrostatographic plate surface. Print deletion and massive carry-over of carrier particles often occur when carrier particles adhere to reusable electrostatographic imaging surfaces. Massive carrier carry-over problems are particularly acute when the developer is employed in solid area coverage machines where excessive quantities of toner particles are removed from carrier particles thereby leaving many carrier particles substantially bare of toner particles. Further, adherence of carrier particles to reusable electrostatographic imaging surfaces promotes the formation of undesirable scratches on the surface during image transfer and surface cleaning operations.

Thus, it is apparent from the description presented above as well as in other development techniques, that the toner is subjected to severe mechanical attrition which tends to break down the particles into undesirable dust fines. The formation of fines is retarded when the toner contains a tough, high molecular weight resin which is capable of withstanding the shear and impact forces imparted to the toner in the machine. Unfortunately, many high molecular weight materials cannot be rapidly fused during a powder image heat fixing step. On the other hand, low molecular weight resins which are easily heat fused at relatively low temperatures are usually undesirable because these materials tend to form thick films on reusable photoconductor surfaces. These films tend to cause image degradation and contribute to machine maintenance down time. Many low molecular weight resins decompose when subjected to fusing conditions in high speed coping and duplicating machines. In addition, low molecular weight resins tend to form tacky images on the copy sheet which are easily smudged and often offset to other adjacent sheets. Additionally, low molecular weight resins are often extremely difficult or even impossible to comminute in conventional grinding apparatus. Also, the toner materials must be capable of accepting a charge of the correct polarity when brought into rubbing contact with the surface of carrier materials in cascade or touchdown development systems. Additionally, many toner materials cannot satisfactorily be transferred by conventional electrostatographic development systems from reusable imaging surfaces in automatic copying and duplicating machines. Since most polymeric toner materials are deficient in one or more of the above areas, there is a continuing need for improved toners and developers.

SUMMARY OF THE INVENTION

It is, therefore, an object of the invention to provide toner compositions overcoming the above-noted deficiencies.

It is another object of this invention to provide a method for controllably altering the triboelectric values of toner materials without markedly changing the other physical and chemical properties of the original polymer material.

It is a further object of this invention to provide toner material manufacturing techniques for producing developer materials having finely-adjusted triboelectric properties.

It is a further object of this invention to render suitable as toner materials many polymeric materials which were heretofore unsuitable as toner materials.

It is another object of this invention to provide developer materials having triboelectric properties which are superior to known toner and developer materials.

The foregoing objects and others are accomplished generally speaking, by the controlled chemical alteration of the triboelectric charging potential of functional polymers employed as toner materials. The controlled variation of the triboelectric behavior of functional polymers provides a means of attaining optimum triboelectric responses of electrostatographic developer materials for specifically defined applications. Thus, in accordance with this invention, monomeric and/or polymeric materials are systematically chemically modified to provide structural effects which yield structure-triboelectric property relationships among amines, amides, alcohols, esters, nitroaromatics, haloaromatics, aromatic ethers, and alkylaromatics. These relationships have been found to be extremely helpful in designing new toners. By this invention, the triboelectric charging properties of toner-carrier pairs are controlled to enable optimum triboelectric relationships in developer compositions.

DETAILED DESCRIPTION OF THE INVENTION

Figure 2:
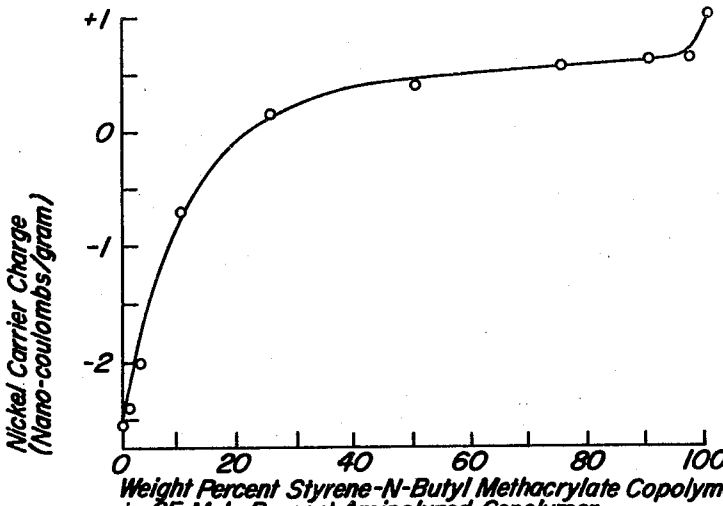
FIG. 2 illustrates the effect of triboelectric charging properties as a function of a mixture composition comprising a styrene-n-butyl methacrylate copolymer and a functionalized copolymer using nickel beads as a carrier.

It is to be noted that, by itself, no material has a triboelectric charge. The magnitude of a triboelectric charge depends upon both the toner and the carrier material. Thus, replacement of one of the components to optimize triboelectric charging properties is generally necessary to provide the desired triboelectric response. By so doing, greater latitude is available for specific electrostatographic applications. In accordance with this invention, it has been found that by varying the degree of chemical modification of polymeric materials for use as toner particles, either stoichiometrically or kinetically, the triboelectric properties of developer materials can be controlled in a continuous manner.

In electrostatographic development of selenium photoconductor latent images, polymers which tend to take on a relatively high negative charge are generally satisfactory for use as toner materials. In electrostatographic development of other photoconductor latent images, for example, zinc oxide, phthalocyanine, cadmium sulfide, polyvinylcarbazole-trinitroflurenone, polymers which tend to acquire relatively high positive charges are generally satisfactory for use as toner materials. In accordance with this invention, the triboelectric properties of developer materials are correlated with their structural composition and thereby predictably controlled. Since the distance between a given toner-carrier pair on a triboelectric charging scale determines the triboelectric charge between them, their relative positions determine the sign of the triboelectric charge. Those materials low on the scale prefer to adopt a positive charge and those materials high on the scale prefer to adopt a negative charge. Appropriate toner-carrier pairs can be selected based on their triboelectric charging or triboelectric series relationship to satisfy a particular acceptable triboelectric charging range requirement for a given electrostatographic machine developer housing.

It has been found that triboelectric behavior is a function of molecular structure which now allows the controlled and progressive modification of the triboelectric charging properties of toner compositions so as to obtain optimum triboelectric charging properties between toner and carrier pairs. Thus, by this invention, adjustment of the triboelectric charging properties of electrostatographic developer materials need not be done in stepwise fashion but may be accomplished in a continuous manner providing a high degree of "fine tuning" of triboelectric properties for developer materials.

In accordance with this invention, the triboelectric charging properties of monomeric and polymeric compounds may be modified by systematic chemical modification by means of aminolysis of their pendant ester functions. Cascade development triboelectric charging evaluations of such functionalized polymers have demonstrated that these materials charge less negatively than the starting polymeric esters. In the resultant amides the propensity for negative charging increases in the following order of terminal group structure for $NH_2$, OH, H.

In addition, to these transformations, functionalized polymers may be further derivatized. For example, an aminolyzed polymer having the general structure

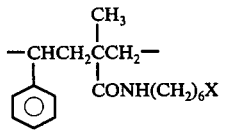

where X may be $NH_2$, OH, $NHCOC_6H_4R$, $OCOC_6H_4R$ and H, and wherein R may be an electron donating or electron releasing substituent provides polymer compositions of varying triboelectric charging potential. More specifically, conversion of the $NH_2$ group to be a benzamide ($X{=}NHCOC_6H_4R$) causes the polymer to accept more negative charge. The nitro substituent (R) causes more negative charging than does methoxy (R). Likewise, conversion of the OH group to $OCOC_6H_4$ R also allows the polymer to accept more negative charge.

It is also noted that the triboelectric charging capacity is controlled by the substituent R of the benzamides ($X{=}NHCOC_6H_4R$) and benzoates ($X{=}OCOC_6H_4R$). The propensity for negative charging increases with increasing electron withdrawing power of R as measured by substituent constants in each case.

An alternative to reactions of polymers in many applications is the polymerization of monomers bearing the desired substituent. The aforementioned techniques may be applied to many polymers such as those disclosed above and their derivatives including styrene-alkylmethacrylates and styrene-alkyl acrylates.

The chemical modification of such materials enables the alteration of materials having optimum physical properties in such a way as to improve their triboelectric properties for electrostatographic use. This invention may serve as a guide for the preparation of toner compositions having "finely-tuned" triboelectric charging properties, and the capacity for continuous control of such properties through variation in extent of reaction may be employed for such purpose.

Any suitable vinyl resin having a melting point of at least about 110° F may be employed in the toners of this invention. The vinyl resin may be a homopolymer or a copolymer of two or more vinyl monomers. Typical monomeric units which may be employed to form constituents of vinyl polymers include: styrene, p-chlorostyrene; vinyl naphthalene; ethylenically unsaturated mono-olefins such as ethylene, propylene, butylene, isobutylene and the like; vinyl esters such as vinyl chloride, vinyl bromide, vinyl fluoride, vinyl acetate, vinyl propionate, vinyl benzoate, vinyl butyrate and the like; esters of alpha-methylene aliphatic monocarboxylic acids such as methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate and the like; acrylonitrile, methacrylonitrile, acrylamide, vinyl ethers such as vinyl methyl ether, vinyl isobutyl ether, vinyl ethyl ether, and the like; vinyl ketones such as vinyl methyl ketones, vinyl hexyl ketone, methyl isopropenyl ketone and the like; vinylidene halides such as vinylidene chloride, vinylidene chlorofluoride and the like; and N-vinyl compounds such as N-vinylpyrrole, N-vinylcarbazole, N-vinylindole, N-vinylpyrrolidene and the like; and mixtures thereof. Generally, suitable vinyl resins employed in the toner have a weight average molecular weight between about 3,000 to about 500,000. The resins may be formed by the polymerization of mixtures of two or more of these unsaturated monomers. The expression "addition polymerization" is intended to include known polymerization techniques such as free radical, anionic and cationic polymerization processes.

The combination of the resin component and colorant whether the resin component is a homopolymer, copolymer, or blend, should have a blocking temperature of at least about 110° F and a melt viscosity of less than about $\mathbf{2.5 \times 10^{-4}}$ poise at temperatures of to about 450° F. When the toner is characterized by a blocking temperature less than about 110° F, the toner particles tend to agglomerate during storage and machine operation and also form undesirable films on the surface of reusable photoreceptors which adversely affect image quality.

Any suitable pigment or dye may be employed as the colorant for the toner particles. Toner colorants are well-known and include, for example, carbon black, nigrosine dye, aniline blue, Calco Oil Blue, chrome yellow, ultra marine blue, duPont Oil Red, Quinoline Yellow, methylene blue chloride, phthalocyanine blue, Malachite Green Oxalate, lamp black, Rose Bengal and mixtures thereof. The pigment or dyes should be present in the toner in a sufficient quantity to render it highly colored so that is will form a clearly visible image on a recording member. Thus, for example, where conventional electrostatographic copies of typed documents are desired, the toner may comprise a black pigment such as carbon black or a black dye such as Amaplast Black dye, available from the National Aniline Products, Inc. Generally, the pigment is employed in an amount from about 1 percent to about 20 percent by weight based on the total weight of the colored toner. If the toner colorant employed is a dye, substantially smaller quantities of colorant may be used. However, since a number of the above pigments used in electrostatographic toner compositions may affect both the glass transition and fusion temperatures of the toner compositions of this invention, their concentration preferably should not exceed about 10 percent by weight of the colored toner.

The toner compositions of the present invention may be prepared by any well-known toner mixing and comminution technique. For example, the ingredients may be thoroughly mixed by blending, mixing and milling the components and thereafter micropulverizing the resulting mixture. Another well-known technique for forming toner particles is to spray-dry a ball-milled toner composition comprising a colorant, a resin, and a solvent.

When the toner materials of this invention are to be employed in a cascade development process, the toner should have an average particle size less than about 30 microns and preferably between about 4 and about 20 microns for optimum results. For use in powder cloud development methods, particle diameters of slightly less than 1 micron are preferred.

Suitable coated and uncoated carrier materials for cascade development are well-known in the art. The carrier particles comprise any suitable solid materials, provided that the carrier particles acquire a charge having an opposite polarity to that of the toner particles when brought in close contact with the toner particles so that the toner particles adhere to and surround the carrier particles. When a positive reproduction of the electrostatic images is desired, the carrier particle is selected so that the toner particles acquire a charge having a polarity opposite to that of the electrostatic image. Alternatively, if a reversal reproduction of the electrostatic image is desired, the carrier is selected so that the toner particles acquire a charge having the same polarity as that of the electrostatic image. Thus the materials for the carrier particles are selected in accordance with their triboelectric properties in respect to the electroscopic toner so that when mixed or brought into mutual contact, one component of the developer is charged positively if the other component is below the first component in the triboelectric series and negatively if the other component is above the first component in a triboelectric series. By proper selection of carrier materials in accordance with their triboelectric effects, the polarities of their charge, when mixed, are such that the electroscopic toner particles adhere to and are coated on the surfaces of carrier particles and also adhere to that portion of the electrostatic image-bearing surface having a greater attraction for the toner than the carrier particles. Typical carriers include sodium chloride, aluminum potassium chloride, Rochelle salt, granular zircon, granular silicon, methyl methacrylate, glass, silicon dioxide, nickel, steel, iron, ferrites, and the like. The carriers may be employed with or without a coating. Many of the foregoing and other typical carriers are described by L. E. Walkup et al in U. S. Pat. No. 2,638,416 and E. N. Wise in U.S. Pat. No. 2,618,552. An ultimate coated carrier particle diameter between about 50 microns to about 1,000 microns is preferred because the carrier particles then possess sufficient density and inertia to avoid adherence to the electrostatic images during the cascade development process. Adherence of carrier beads to electrostatographic drums is undesirable because of the formation of deep scratches on the surface during the imaging transfer and drum cleaning steps, particularly where cleaning is accomplished by a web cleaner such as the web disclosed by W. P. Graff, Jr., et al in U.S. Pat. No. 3,186,838. Also print deletion occurs when carrier beads adhere to electrostatographic imaging surfaces. Generally speaking, satisfactory results are obtained when about 1 part toner is used with about 10 to 200 parts by weight of carrier.

The toner compositions of the instant invention may be employed to develop electrostatic latent images on any suitable electrostatic latent image-bearing surface including conventional photoconductive surfaces. Well-known photoconductive materials include vitreous selenium, organic or inorganic photoconductors embedded in a non-photoconductive matrix, organic or inorganic photoconductors embedded in a photoconductive matrix, or the like. Representative patents in which photoconductive materials are disclosed include U.S. Pat. No. 2,903,542 to Ullrich, U.S. Pat. No. 2,970,906 to Bixby, U.S. Pat. No. 3,121,006 to Middleton, U.S. Pat. No. 3,121,007 to Middleton, and U.S. Pat. No. 3,151,982 to Corrsin.

DESCRIPTION OF PREFERRED EMBODIMENTS

The following examples further define, describe, and compare methods of preparing the toner materials of the present invention and of utilizing them to develop electrostatic latent images. Parts and percentages are by weight unless otherwise indicated.

In the following, the relative triboelectric values generated by contact of carrier beads with toner particles is measured by means of a cascade device. The device comprises a grounded metal plate set at an arbitrary but constant angle of elevation to horizontal, for example, 30°, and a cup at the bottom of the incline. The cup is not attached to the incline and is thus not grounded; it is attached to an electrometer. The material to be tested is coated onto a metallic sheet, such as aluminum, and this is attached to the incline. Then beads of the desired carrier material are cascaded down the film and into the electrometer cup, where the charge acquired by the beads is measured. From this quantity and the weight of the beads the charge to mass ratio is calculated. This quantity is a direct measure of the triboelectric charging capacity of the polymeric film. The measurement is done at constant relative humidity and temperature. Since triboelectric measurements are relative, the measurements should, for comparative purposes, be conducted under substantially identical conditions.

EXAMPLE I

Functionalized polymers were prepared for toner materials by ester group aminolysis of a styrene-n-butyl methacrylate copolymer (2.54:1.00 mole ratio) with an aminoalcohol resulting in formation of hydroxalkylamide functions.

A mixture of about 117.5 grams (0.289 mole of ester functions based on elemental analysis) of the styrene-n-butyl methacrylate, about 41.0 grams (0.350 mole) of 6-aminohexanol, and about 39.3 grams (0.350 mole) of 1,4-diazabicyclo [2,2,2] octane was stirred under dry nitrogen at about 180° C (oil bath temperature 205° C) using an ambient air-cooled condenser to allow escape of the n-butanol produced. Samples were removed periodically, quenched in 10% HCl by volume and purified as follows. Each sample was dissolved in tetrahydrofuran and then 10% HCl was added. The liquid phase was decanted from the gummy polymer. This procedure was repeated twice, followed by a fourth and fifth wash using 5% methanolic HCl. The polymer was taken up in tetrahydrofuran and precipitated by dropwise addition with rapid stirring to 10% HCl. After homogenization in a blender and filtration, the process was repeated. The polymer in tetrahydrofuran solution was then precipitated in like manner from deionized water, and this process repeated. After a final precipitation from methanol, the sample was dried in vacuo. Generally, the polymer sample was dissolved in about five times its weight of tetrahydrofuran. Volumes of the precipitating solutions were 6–10 times those of the polymer-tetrahydrofuran solution.

Figure 1:
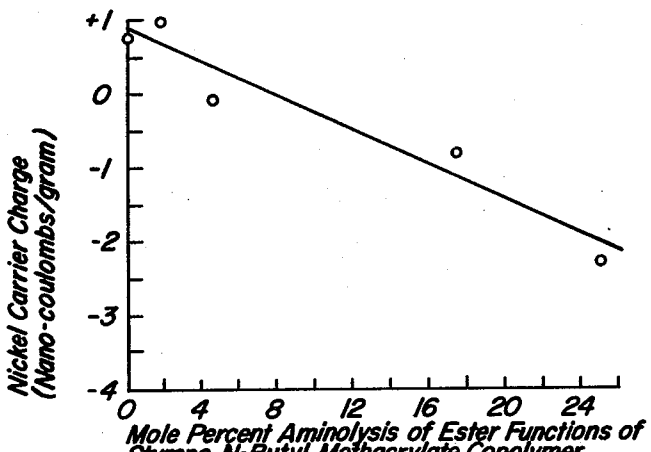
FIG. 1 illustrates the dependence of triboelectric charging on the degree of conversion of the functionalized copolymer when using nickel beads as a carrier.

Following the above procedure to obtain functionalized polymers by aminolysis, the ester functions of styrene-N-butyl methacrylate copolymer (2.54:1.00 mole ratio) were aminolyzed with 6-aminohexanol from 0 to 25 mole percent of available ester functions and films were cast from solution onto aluminum plates and thoroughly dried. FIG. 1 illustrates the dependence of triboelectric charging on the degree of conversion of the functionalized copolymer when using 250 micron nickel beads as a carrier. Other carriers gave comparable results.

EXAMPLE II

Figure 3:
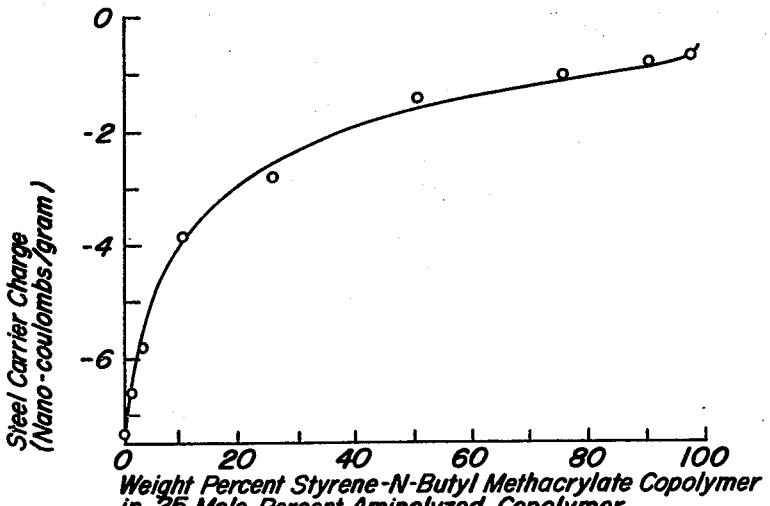
FIG. 3 illustrates the effect of triboelectric charging properties as a function of a mixture composition comprising a styrene-n-butyl methacrylate copolymer and a functionalized copolymer using steel beads as a carrier.

The effect of triboelectric charging properties as a function of mixture composition was studied employing solutions of a styrene-n-butyl methacrylate copolymer (2.54:100 mole ratio) and the copolymer which had been functionalized via aminolysis with 6-aminohexanol to the extent of 25 mole percent of available ester functions. From 0 to 100 weight percent of the styrene-n-butyl methacrylate copolymer was mixed with the functionalized copolymer. Films were cast from solution onto aluminum plates and thoroughly dried. The cascade triboelectric charging properties obtained using these films are illustrated in FIG. 2 when using 250 micron nickel beads as a carrier, and in FIG. 3 when using 250 micron steel carrier beads. It is seen that triboelectric charging properties are related to composition in an S-shaped fashion and are not linear as might be expected ideally. By comparing quantitatively these results with those obtained in Example I as illustrated in FIG. 1 it was concluded that due to its higher surface energy, proportionally less of the functionalized material resides on the surface of the polymer film that in the bulk. Therefore, the prediction of triboelectric charging properties for mixtures is quantitatively precarious, while chemical alterations of a single phase offers linear control of triboelectric charging properties.

EXAMPLE III

Functionalized polymers were prepared for toner materials by ester group aminolysis of a styrene-n-butyl methacrylate copolymer (2.54:1.00 mole ratio) with a diamine resulting in formation of aminoalkylamide functions.

A mixture of about 200 grams of the styrene-n-butyl methacrylate copolymer and about 50.0 grams of hexane-1.6-diamine was stirred under dry nitrogen at about 180° C (oil bath temperature 205° C) for a period of about 20 hours using an ambient air-cooled condenser to allow escape of the n-butanol produced. Samples were removed periodically, quenched in 10% HCl by volume and purified as follows. Each sample was dissolved in tetrahydrofuran and then 10% HCl was added. The liquid phase was decanted from the gummy polymer. This procedure was repeated twice, followed by a fourth and fifth wash using 5% methanolic HCl. The polymer was taken up in tetrahydrofuran and precipitated by dropwise addition with rapid stirring to 10% HCl. After homogenization in a blender and filtration, the process was repeated. The polymer in tetrahydrofuran solution was then precipitated in like manner from deionized water, and this process repeated. After a final precipitation from methanol, the sample was dried in vacuo. Generally, the polymer sample was dissolved in about five times its weight of tetrahydrofuran. Volumes of the precipitating solutions were 6–10 times those of the polymer-tetrahydrofuran solution.

Following the above procedure to obtain functionalized polymers by aminolysis, the esters functions of styrene-n-butyl methacrylate copolymer (2.54:1.00 mole ratio) were aminolyzed with hexane-1,6-diamine from 0 to 2.3 mole percent of available ester functions and films were cast from solution onto aluminum plates and thoroughly dried. Triboelectric measurements following the procedure of Example I illustrated the dependence of triboelectric charging on the degree of conversion of the functionalized copolymer when using 250 micron nickel beads as a carrier. Other carriers gave comparable results.

EXAMPLE IV

Functionalized polymers were prepared for toner materials by ester group aminolysis of a styrene-n-butyl methacrylate copolymer (2.54:1.00 mole ratio) with an alkyl amine resulting in formation of alkylamide functions. A mixture of about 117.5 grams (0.289 mole of ester functions based on elemental analysis) of the styrene-n-butyl methacrylate, about 35.4 grams (0.350 mole) of aminohexane, and about 39.3 grams (0.350 mole) of 1,4-diazabicyclo [2,2,2]- octane was stirred under dry nitrogen at about 180° C (oil bath temperature 205° C) using an ambient air-cooled condenser to allow escape of the n-butanol produced. Samples were removed periodically, quenched in 10% HCl by volume and purified as follows. Each sample was dissolved in tetrahydrofuran and then 10% HCl was added. The liquid phase was decanted from the gummy polymer. This procedure was repeated twice, followed by a fourth and fifth wash using 5% methanolic HCl. The polymer was taken up in tetrahydrofuran and precipitated by dropwise addition with rapid stirring to 10% HCl. After homogenization in a blender and filtration, the process was repeated. The polymer in tetrahydrofuran solution was then precipitated in like manner from deionized water, and this process repeated. After a final precipitation from methanol, the sample was dried in vacuo. Generally, the polymer sample was dissolved in about five times its weight of tetrahydrofuran. Volumes of the precipitating solutions were 6–10 times those of the polymer-tetrahydrofuran solution.

Following the above procedure the ester functions of styrene-n-butyl methacrylate copolymer (2.54:1.00 mole ratio) were aminolyzed with aminohexane to the extent of 10 mole percent of available ester functions.

EXAMPLE V

The aminolyzed copolymers of Example I were derivatized. The copolymers have the general structure

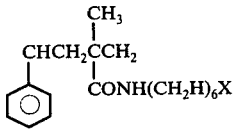

where 1, X = $NH_2$; 2, X = OH; 3, X = $NHCOC_6H_4R$-p; 4, X=$OCOC_6H_4R$-p; and 5, X = H.

To a stirred solution of about 10.0 grams of the hydroxy polymer in about 30 ml. of dry pyridine was added a solution of about 5.0 grams of substituted benzoyl chloride in dry pyridine. The solution was refluxed about 18 hours and then poured into about 400.0 ml of 10% by volume HCl. After homogenization in a blender with 10% by volume HCl, then saturated sodium bicarbonate solution, and then water, the polymer was dissolved in tetrahydrofuran and precipitated into 10% by volume HCl. In like manner, the polymer was successively precipitated from saturated sodium bicarbonate twice, methanol and water thrice. In this way, the following p-substituted benzoate esters were prepared: $NO_2$ (60%), $OCH_3$ (85%), Cl (100%), H (90%). The degree of conversions was determined by elemental analysis.

While the degree of conversions with various reagents were not exactly the same, trends can be discerned from Table 1. That is, conversion of 1 to a benzamide 3 causes the polymer to accept more negative charge as desired for toners. The nitro substituent causes more negative charging than does methoxy, an electron releasing substituent. In a similar way, conversion of 2 to 4 also allows the polymer to accept more negative charge. To ascertain the effect of changing the ester linkage, of a styrene-n-butyl methacrylate copolymer to an amide linkage, 5 was prepared by aminolysis of the copolymer with hexylamine. As can be seen from Table I, the amide polymer 5 charges more positively than the ester polymer even though the degree of conversion to 5 is relatively low.

TABLE I

Effect of polymer structure on triboelectric charging at about 30% relative humidity

| Polymer | 250 micron nickel carrier charge (NANO-coulombs/gram) |
|---|---|
| Copolymer of styrene-n-butyl methacrylate | +1.1 |
| 2a | −2.5 |
| 4, R = $NO_2$[b] | −1.4 |
| 4, R = Cl[c] | −1.9 |
| 4, R = H[d] | −1.5 |
| 4, R = $OCH_3$[e] | −1.9 |
| 3, R = $NO_2$ | +1.2 |

TABLE I-continued

Effect of polymer structure on triboelectric charging at about 30% relative humidity

| Polymer | 250 micron nickel carrier charge (NANO-coulombs/gram) |
|---|---|
| 3, R = $OCH_3$ | +0.73 |

[a]28 mole % of ester groups of copolymer of styrene-n-butyl methacrylate aminolyzed
[b]60 mole % of available OH groups esterified
[c]100 mole % of available OH groups esterified
[d]90 mole % of available OH group esterified
[e]85 mole % of available OH groups esterified From these results, it can be concluded that the effect of polymer structure on its triboelectric charging capacity is as follows: Electron withdrawing substituents attached to aromatic moieties increase the negative charging ability of the material relative to electron releasing substituents. In aliphatic systems, the extent of negative charging of the material increases in the order $NH_2 < OH < H$. Benzamides and alkanamides charge more negatively then the corresponding free amines. Benzoates and alkanoates charge more negatively than the corresponding free alcohols. In aliphatic systems, the extent of negative charging is greater for esters than for amides.

Although specific components, proportions and procedures have been stated in the above description of the preferred embodiments of the novel toner compositions, other suitable components, proportions and procedures as listed above may be used with similar results. Further, other materials and procedures may be employed to synergize, enhance or otherwise modify the novel system.

Other modifications and ramifications of the present invention will appear to those skilled in the art upon the reading of this disclosure. These are intended to be included within the scope of this invention.

What is claimed is:

1. An electrostatographic developer composition comprising finely-divided toner particles electrostatically clinging to the surface of carrier particles, said toner particles having an average particle diameter of less than about 30 microns, said toner particles comprising a colorant and a polymer containing pendant ester functions, said polymer having been selected from the group consisting of styrene-alkylmethacrylate and styrene-alkylacrylate, and wherein said polymer has been exposed to systematic chemical alteration of said pendent ester functions by aminolysis with an aminoalcohol to result in the formation of hydroxyalkylamide functions and provide toner particles characterized as having controlled triboelectric charging properties.

2. An electrostatographic developer composition in accordance with claim 1 wherein said polymer has a melting point of at least about 110° F.

3. An electrostatographic developer composition in accordance with claim 2 wherein said polymer has a weight average molecular weight between about 3,000 to about 500,000.

4. An electrostatographic developer composition in accordance with claim 1 wherein said toner particles have a blocking temperature of at least about 110° F and a melt viscosity of less than about $2.5 \times 10^{-4}$ poise at temperatures of up to about 450° F.

5. An electrostatographic developer composition in accordance with claim 1 wherein said colorant is selected from the group consisting of pigments and dyes.

6. An electrostatographic developer composition in accordance with claim 1 wherein said colorant is present in an amount of from about 1 percent to about 20 percent by weight based on the weight of said toner particles.

7. An electrostatographic developer composition in accordance with claim 1 wherein said polymer is the product of aminolyzed styrene-n-butyl methacrylate.

8. An electrostatographic developer composition in accordance with claim 1 wherein said aminoalcohol is 6-aminohexanol.

9. An electrostatographic developer composition in accordance with claim 1 wherein up to about 25 mole percent of said ester functions of said polymer have been aminolyzed with said aminoalcohol.

10. An electrostatographic developer composition for use in developing electrostatic latent images on a recording surface, said developer composition comprising finely-divided toner particles electrostatically clinging to the surface of carrier particles, said toner particles having an average particle diameter of less than about 30 microns, and comprising a colorant and a polymer selected from the group consisting of styrene-alkylmethacrylate and styrene-alkylacrylate, and wherein said polymer has been exposed to systematic chemical alteration by ester group aminolysis to produce an aminolyzed polymer having the general structure

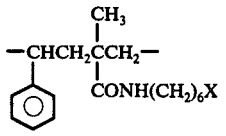

where X may be $NH_2$, OH, and H, and provide toner particles characterized as having controlled triboelectric charging properties.

11. An electrostatographic imaging process comprising the steps of providing an electrostatographic imaging member having a recording surface, forming an electrostatic latent image on said recording surface, and contacting said electrostatic latent image with a developer composition comprising finely-divided toner particles electrostatically clinging to the surface of carrier particles, said toner particles having an average particle diameter of less than about 30 microns, said toner particles comprising a colorant and a polymer containing pendant ester functions, said polymer having been selected from the group consisting of styrene-alkylmethacrylate and styrene-alkylacrylate, and wherein said polymer has been exposed to systematic chemical alteration of said pendant ester functions by aminolysis with an aminoalcohol resulting in the formation of hydroxyalkylamide functions and to provide toner particles characterized as having controlled triboelectric charging properties, whereby at least a portion of said finely-divided toner particles are attracted to and deposited on said recording surface in conformance with said electrostatic latent image.

* * * * *